US008177094B2

(12) United States Patent
Haimi

(10) Patent No.: US 8,177,094 B2
(45) **Date of Patent: *May 15, 2012**

(54) PUMP LID AND CONTAINERS EMPLOYING SUCH

(75) Inventor: Shlomo Haimi, Or Akiva (IL)

(73) Assignee: Captech Ltd., Or Akiva (IL)

( * ) Notice: Subject to any disclaimer, the term of this patent is extended or adjusted under 35 U.S.C. 154(b) by 405 days.

This patent is subject to a terminal disclaimer.

(21) Appl. No.: 12/512,052

(22) Filed: Jul. 30, 2009

(65) Prior Publication Data

US 2010/0155412 A1 Jun. 24, 2010

Related U.S. Application Data

(63) Continuation-in-part of application No. 12/342,092, filed on Dec. 23, 2008.

(51) Int. Cl.

| | |
|---|---|
| ***B67D 7/66*** | (2010.01) |
| ***B65D 83/00*** | (2006.01) |
| ***B65B 31/04*** | (2006.01) |
| *B67D 1/08* | (2006.01) |

(52) U.S. Cl. ..... 222/1; 222/383.2; 222/401; 222/321.7; 222/152; 141/65

(58) Field of Classification Search ..... 222/383.2, 222/401, 321.7, 368, 152, 3, 1; 215/228; 220/212, 231, 203.06; 141/65, 94, 95
See application file for complete search history.

(56) References Cited

U.S. PATENT DOCUMENTS

| | | | | |
|---|---|---|---|---|
| 4,610,665 A | | 9/1986 | Matsumoto et al. | |
| 4,823,968 A | * | 4/1989 | Handzlik | 215/228 |
| 4,932,094 A | | 6/1990 | McCowin | |
| 5,071,020 A | * | 12/1991 | Reutter | 220/203.06 |
| 5,152,425 A | * | 10/1992 | Baudin | 222/1 |
| 5,406,992 A | * | 4/1995 | Miramon | 141/65 |
| 5,469,979 A | * | 11/1995 | Chiou | 215/228 |
| 5,944,212 A | * | 8/1999 | Chang | 220/212 |
| 5,992,666 A | * | 11/1999 | Wu | 220/212 |
| 6,131,753 A | * | 10/2000 | Lynch | 215/228 |
| 6,375,024 B1 | * | 4/2002 | Park | 215/262 |
| 6,637,321 B2 | * | 10/2003 | Wang | 99/472 |
| 6,973,945 B2 | | 12/2005 | Haimi | |
| 7,198,074 B2 | | 4/2007 | Lemme et al. | |
| 7,527,179 B2 | | 5/2009 | Haimi | |
| 7,757,725 B2 | * | 7/2010 | Wang et al. | 141/65 |

* cited by examiner

*Primary Examiner* — Kevin P Shaver
*Assistant Examiner* — Nicholas Weiss
(74) *Attorney, Agent, or Firm* — Mark M. Friedman

(57) ABSTRACT

A container for pressurized discharge of fluid contained therein, the container having a container body, a pump lid deployed on the container body for pressurizing an interior volume of the container, a release control arrangement; and an outlet nozzle. The pump lid has a rotatable pump cylinder configuration and a pump piston mechanically associated with the pump cylinder configuration such that at least a portion of the piston is deployed within the pump cylinder, thereby defining between them a variable pump volume, the pump piston configured with a substantially cylindrical piston wall having an interior surface and an exterior surface such that a portion of the interior surface is configured for releasable attachment to the container and a portion of the exterior surface interacts with the rotatable pump cylinder configuration. The association is such that rotation of the pump cylinder configuration generates linear motion of said rotatable pump cylinder configuration.

11 Claims, 14 Drawing Sheets

FIG. 13A
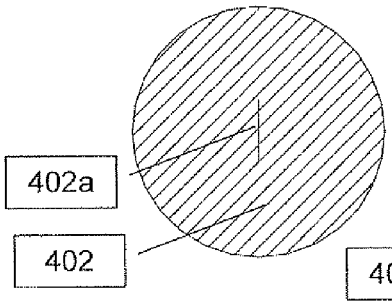
FIG. 13B
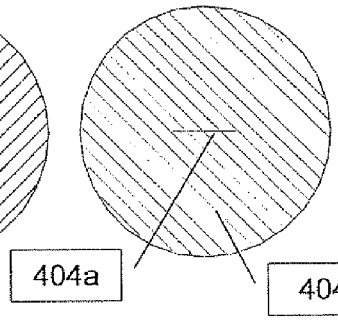
FIG. 13C
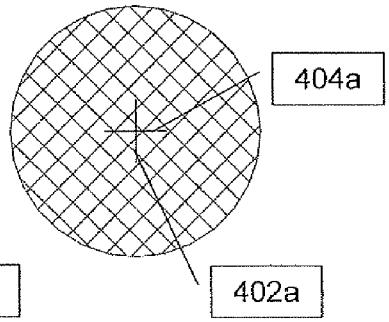
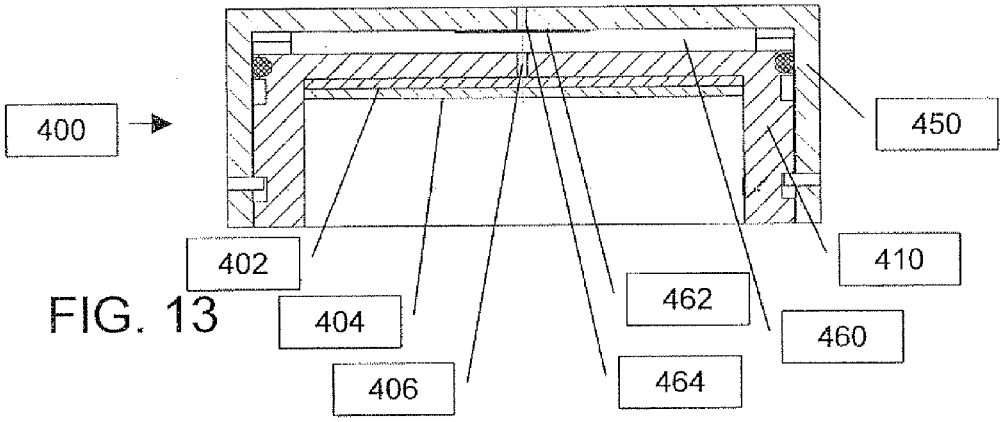
FIG. 13
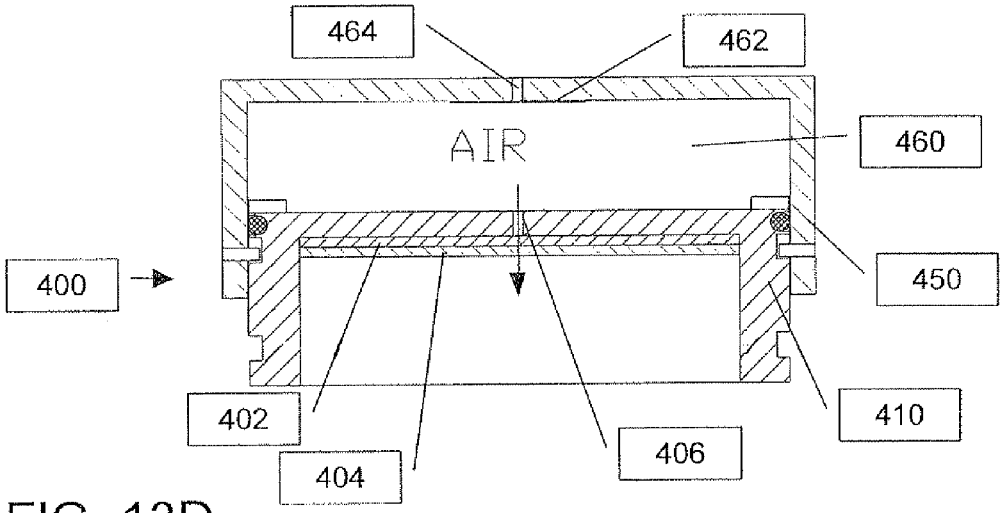
FIG. 13D

PUMP LID AND CONTAINERS EMPLOYING SUCH

This patent application is a Continuation-In-Part of U.S. patent application Ser. No. 12/342,092 filed 23 Dec. 2008 and still pending.

FIELD AND BACKGROUND OF THE INVENTION

The present invention relates to pump lids for use with containers and, in particular, it concerns improvements to such lids.

Issued U.S. Pat. No. 6,973,945 and pending U.S. Patent Application No. 2005/0274734, both to the present inventor, describe different embodiments of a container lid that include a pumping configuration such that rotational movement of one component of the pump lid is translated into linear movement of either the piston element or the cylinder element of the pump lid. The intention of such a pump lid is that ambient air may be pumped into the container, thereby creating a pressurized state within the container. Alternatively, air may be pumped out of the interior volume of the container, thereby creating of state of at least partial vacuum within the container.

The present invention comes to provide certain improvement to these lids which reduce the overall size of the pump lid and simplify manufacture and assembly of the pump lid.

There is therefore a need for an improved pump lid for use on a container.

SUMMARY OF THE INVENTION

The present invention is an improved pump lid for use on a container.

According to a the teachings of the present invention there is provided a container for the pressurized discharge of a fluid contained therein, the container comprising: (a) a container body; (b) a pump lid deployed on the container body for pressurizing an interior volume of the container, the pump lid having: (i) a rotatable pump cylinder configuration; and (ii) a pump piston mechanically associated with the rotatable pump cylinder configuration such that at least a portion of the piston is deployed within the pump cylinder, thereby defining between them a variable pump volume, the pump piston configured with a substantially cylindrical piston wall having an interior surface and an exterior surface such that at least a portion of the interior surface is configured for releasable attachment to the container and at least a portion of the exterior surface interacts with the rotatable pump cylinder configuration; wherein the association is such that rotation of the rotatable pump cylinder configuration generates linear motion of the rotatable pump cylinder configuration; (c) a release control arrangement; and (d) an outlet nozzle.

According to a further teaching of the present invention, there is also provided a bather deployed within the interior volume of the container so as to separate pressurized air from the fluid contained in the container.

There is also provided according to the teachings of the present invention, a method for discharging pressurized fluid from a container, the method comprising: (a) providing a container body; (b) providing a pump lid deployed on the container body for pressurizing an interior volume of the container, the pump lid having: (i) a rotatable pump cylinder configuration; and (ii) a pump piston mechanically associated with the rotatable pump cylinder configuration such that at least a portion of the piston is deployed within the pump cylinder, thereby defining between them a variable pump volume, the pump piston configured with a substantially cylindrical piston wall having an interior surface and an exterior surface such that at least a portion of the interior surface is configured for releasable attachment to the container and at least a portion of the exterior surface interacts with the rotatable pump cylinder configuration; wherein the association is such that rotation of the rotatable pump cylinder configuration generates linear motion of the rotatable pump cylinder configuration; (c) actuating the pump lid so as to pressurize an interior volume of the container; and (d) activating a release control arrangement so as to discharge the fluid through an outlet nozzle.

There is also provided according to the teachings of the present invention, a pump lid assembly for use with a container, the lid assembly comprising: (a) a rotatable pump cylinder configuration; (b) a pump piston mechanically associated with the rotatable pump cylinder configuration such that at least a portion of the piston is deployed within the pump cylinder, thereby defining between them a variable pump volume, the pump piston configured with a substantially cylindrical piston wall having an interior surface and an exterior surface such that at least a portion of the interior surface is configured for releasable attachment to the container and at least a portion of the exterior surface interacts with the rotatable pump cylinder configuration; wherein the association is such that rotation of the rotatable pump cylinder configuration generates linear motion of the rotatable pump cylinder configuration; and (c) a one-way valve arrangement comprising at least one valve component having a through slit through which air is forced by the linear motion.

According to a further teaching of the present invention, the exterior surface of the cylindrical piston wall includes at least one pin element extending laterally therefrom.

According to a further teaching of the present invention, the rotatable pump cylinder configuration includes a substantially cylindrical cylinder wall that defines a pump cylinder region in which the pump piston is deployed, the substantially cylindrical cylinder wall configured with a wave shaped groove into which the pin element extends.

According to a further teaching of the present invention, the rotatable pump cylinder configuration includes at least two components that when assembled define between them the wave shaped groove.

According to a further teaching of the present invention, the two components, when assembled, define between them the wave shaped groove and are configured such that a first component includes a top wall and a side wall of the wave shaped groove and a second component includes a bottom wall of the wave shaped groove.

According to a further teaching of the present invention, the exterior surface of the cylindrical piston wall includes a resilient lip that extends around a periphery of the cylindrical wall and provides an air-tight seal between the rotatable pump cylinder configuration and the pump piston element during an expansion stroke, and when under pressure of a compression stroke, allows air to pass between the rotatable pump cylinder configuration and the pump piston element.

According to a further teaching of the present invention, the rotation of the rotatable pump cylinder configuration generates linear motion of the rotatable pump cylinder configuration so as to create a state of at least partial vacuum within the container.

According to a further teaching of the present invention, the rotation of the rotatable pump cylinder configuration generates linear motion of the rotatable pump cylinder configuration so as to create a pressurized state within the container.

According to a further teaching of the present invention, the at least one valve component is configured as at least two valve components, each of the at least two valve components having a slit wherein upon deployment, the slits are aligned so as to intersect one another at an angle.

According to a further teaching of the present invention, the slits are aligned so as to intersect one another at right angles.

BRIEF DESCRIPTION OF THE DRAWINGS

The invention is herein described, by way of example only, with reference to the accompanying drawings, wherein:

FIG. 13 is a schematic cross-sectional view of an illustrative pump lid according to the teachings of the present invention, illustrating a pressurizing pump arrangement;

FIGS. 13A-13C are schematic top views of the components of the valve configuration of the pressurizing pump lid of FIG. 13;

FIG. 13D is a schematic cross-sectional view of the illustrative pump lid of FIG. 13, illustrating the pump cylinder is a raised position;

DESCRIPTION OF THE PREFERRED EMBODIMENTS

The present invention is an improved pump lid for use on a container.

The principles and operation of an improved pump lid according to the present invention may be better understood with reference to the drawings and the accompanying description.

By way of introduction, as mentioned above, the present invention comes to improve the inventor's prior version of a pump lid as disclosed in U.S. Pat. No. 6,973,945 and U.S. Patent Application No. 2005/0274734, both of which are incorporated by reference as if they were fully set forth herein. These improvements include a shorter profile, an increase in piston diameter, thereby increasing suction and the compression capacity of the pump and ease of manufacture.

The shortened profile is accomplished by configuring the container attachment arrangement in a hollow region of the interior of the piston. That is to say, the pump lid of the present invention is deployed on a container such that when the lid is attached to the container at least a portion of the piston circumscribes the part of the container. In the previous versions of the pump lid, the pump arrangement extends above the seat portion that is configured for attachment to the container. The increase in piston diameter is the result of having the piston circumscribe the container.

Figure 7:
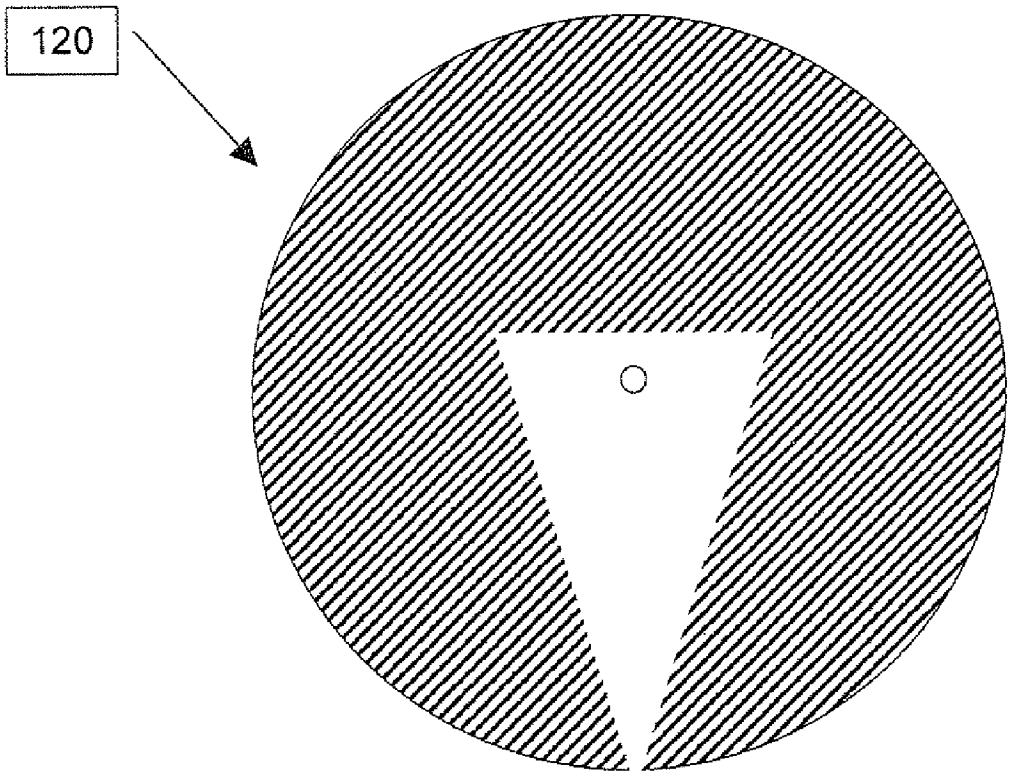
FIG. 7 is a schematic bottom view of a valve sticker constructed and operational according to the teachings of the present invention.

Manufacture of the pump lid of the present invention is simplified in several ways, including configuring the rotatable cylinder in two pieces such that the wave shaped groove is realized by the joining together of the two pieces, as will be discussed below in detail. Further, the valves may be configured with lip valves (also known as sticker valves), as illustrated in FIG. 7, that are installed over valve openings.

It will be appreciated that similar to the previous versions of a pump lid, rotational movement of one component of the pump lid is translated into linear movement of another element of the pump lid. Further, the pump lid of the present invention may be configured to pump air out of the interior volume of the container, thereby creating of state of at least partial vacuum within the container. Alternatively, ambient air may be pumped into the container, thereby creating a pressurized state within the container.

Figure 1:
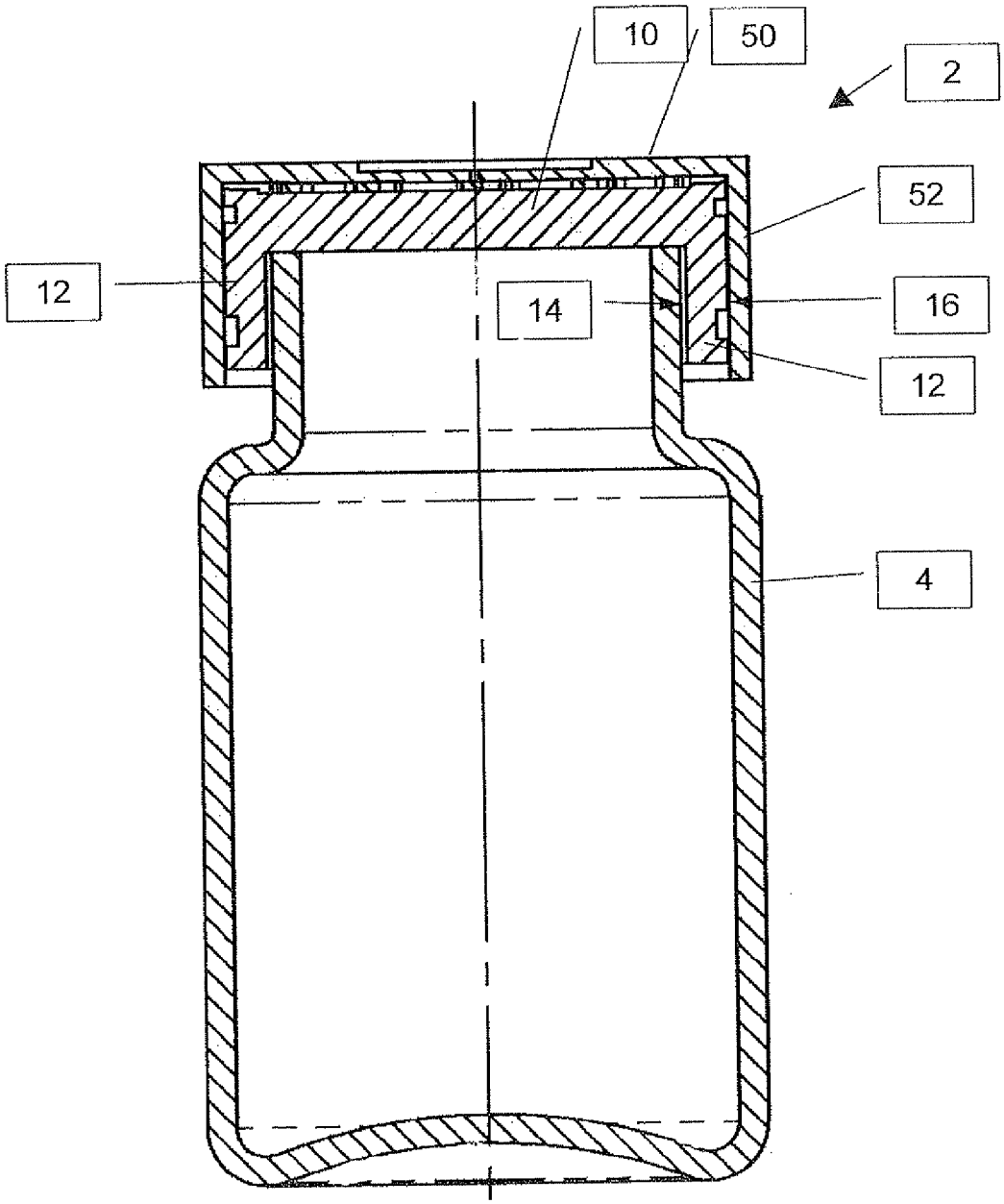
FIG. 1 is a schematic side sectional view illustrating the main components of a pump lid constructed and operational according to the teachings of the present invention, deployed on a container.
Figure 2:
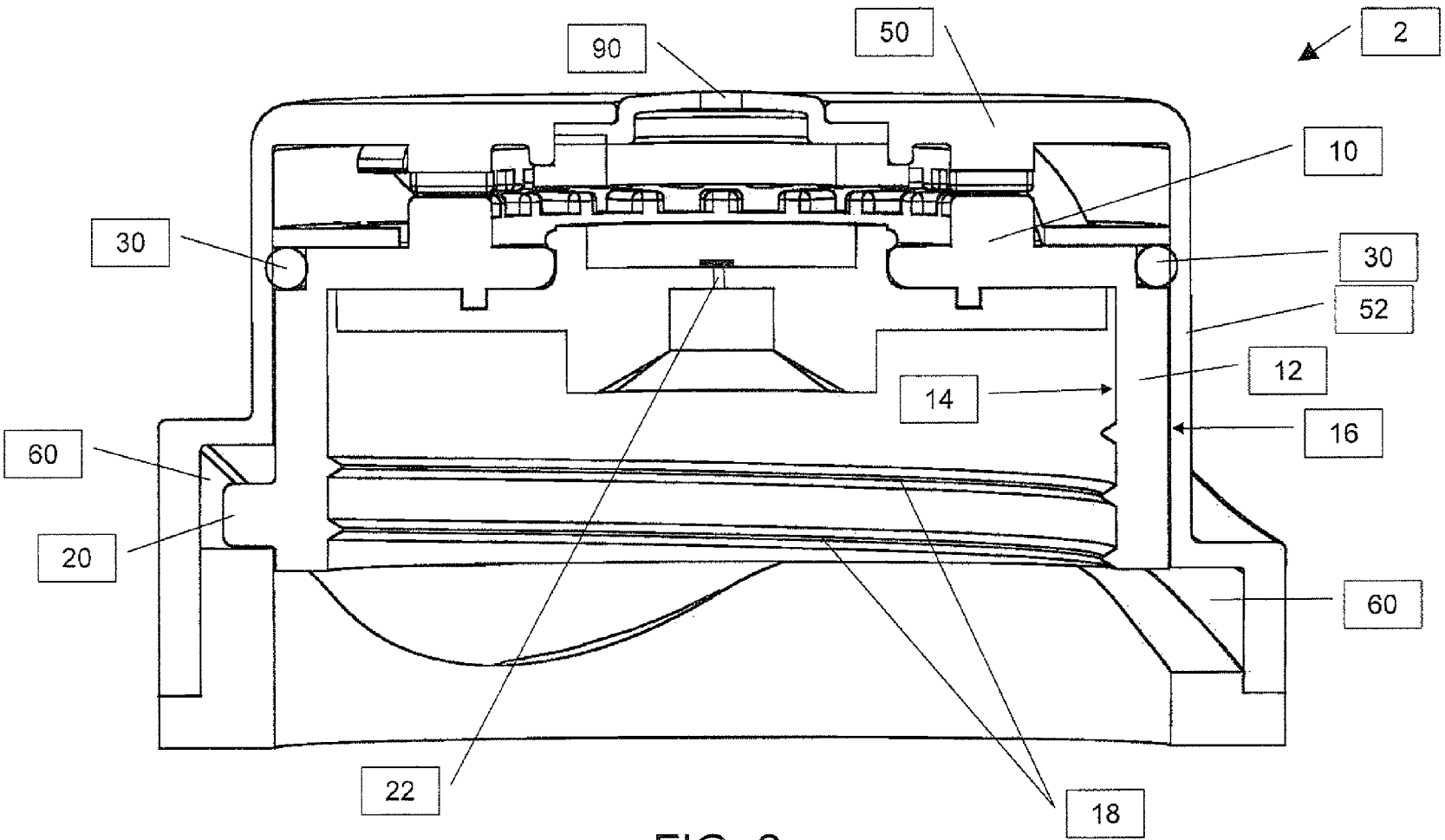
FIG. 2 is a cross sectional elevation of a first preferred embodiment of a pump lid constructed and operational according to the teachings of the present invention, showing the cylinder at the end of a compression stroke.
Figure 3:
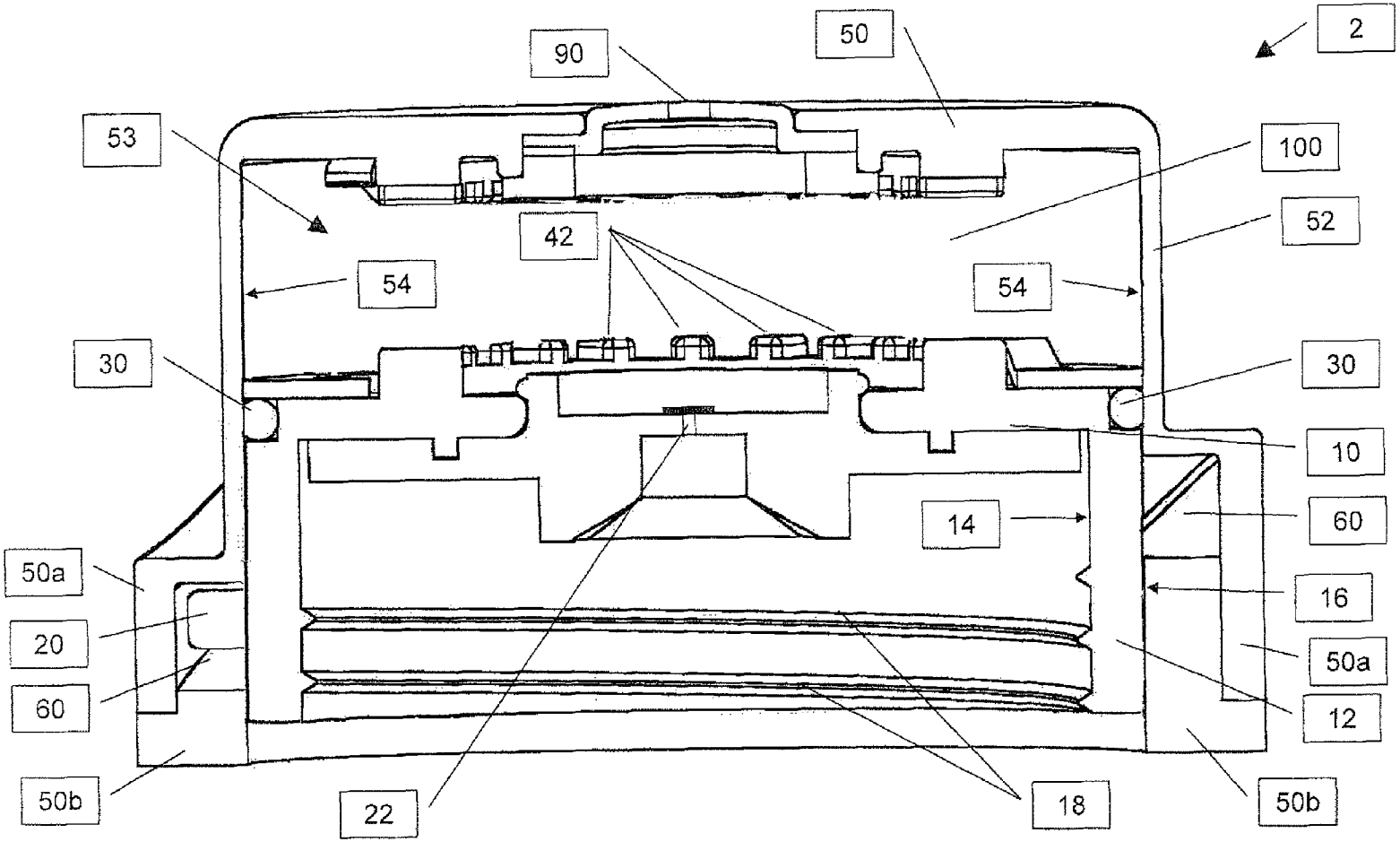
FIG. 3 is a cross sectional elevation of the embodiment of FIG. 2, showing the cylinder at the end of an expansion stroke.
Figure 4:
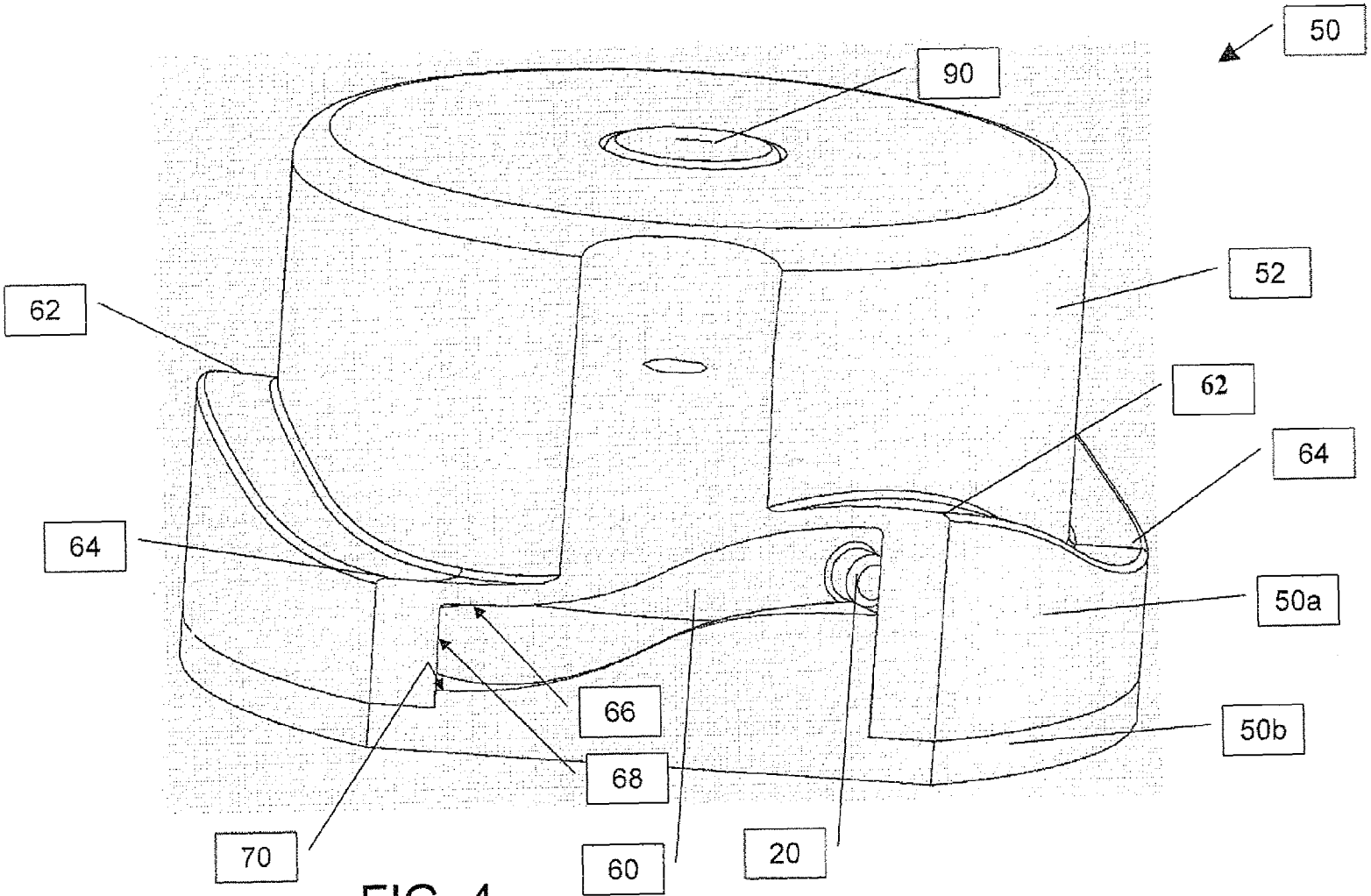
FIG. 4 is a partial cut-away view of the embodiment of FIG. 2, showing the association of the wave-shaped groove and the pump actuation pin.
Figure 5:
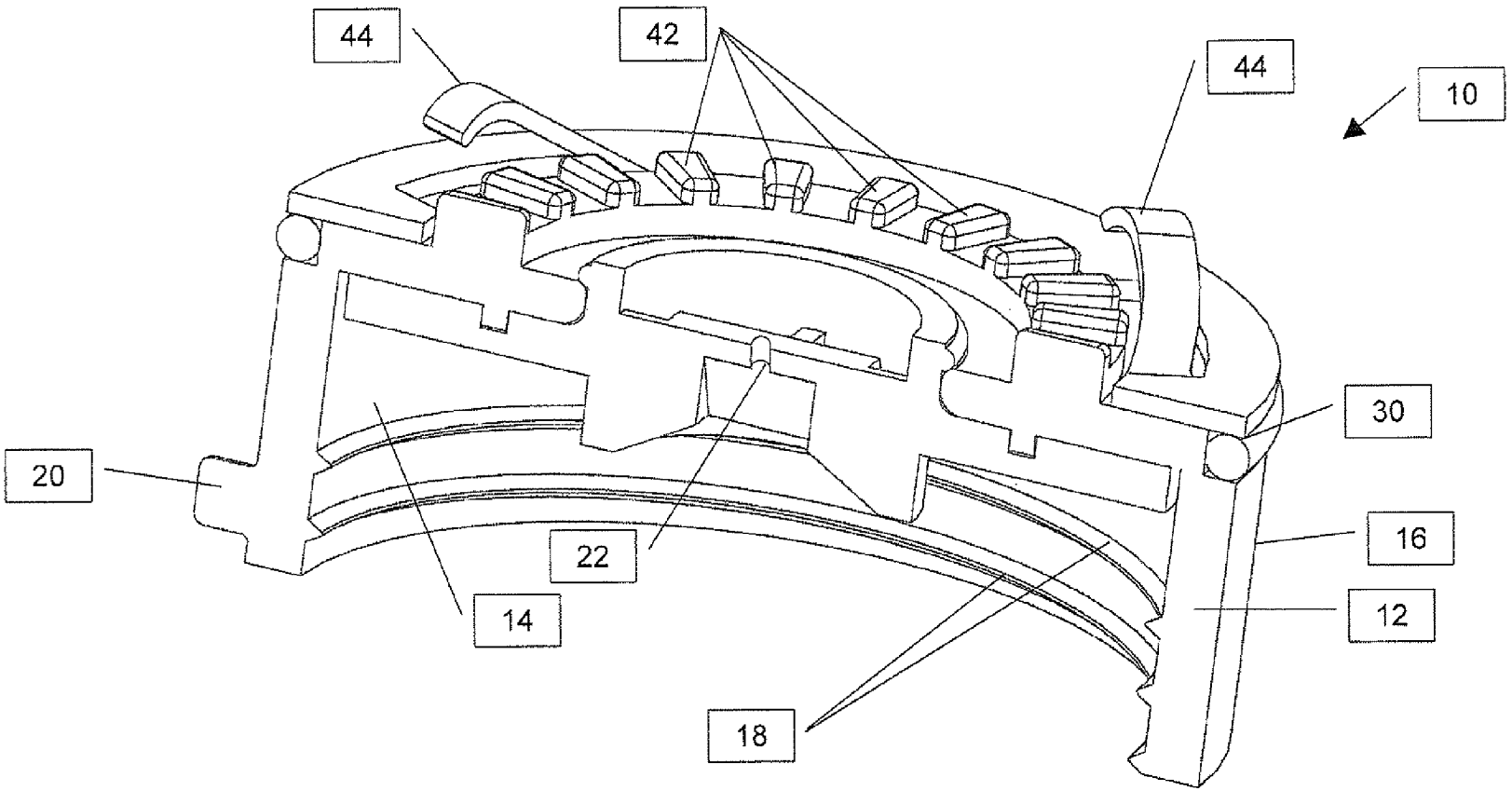
FIG. 5 is an isometric cross section of the pump piston of FIG. 3.
Figure 6:
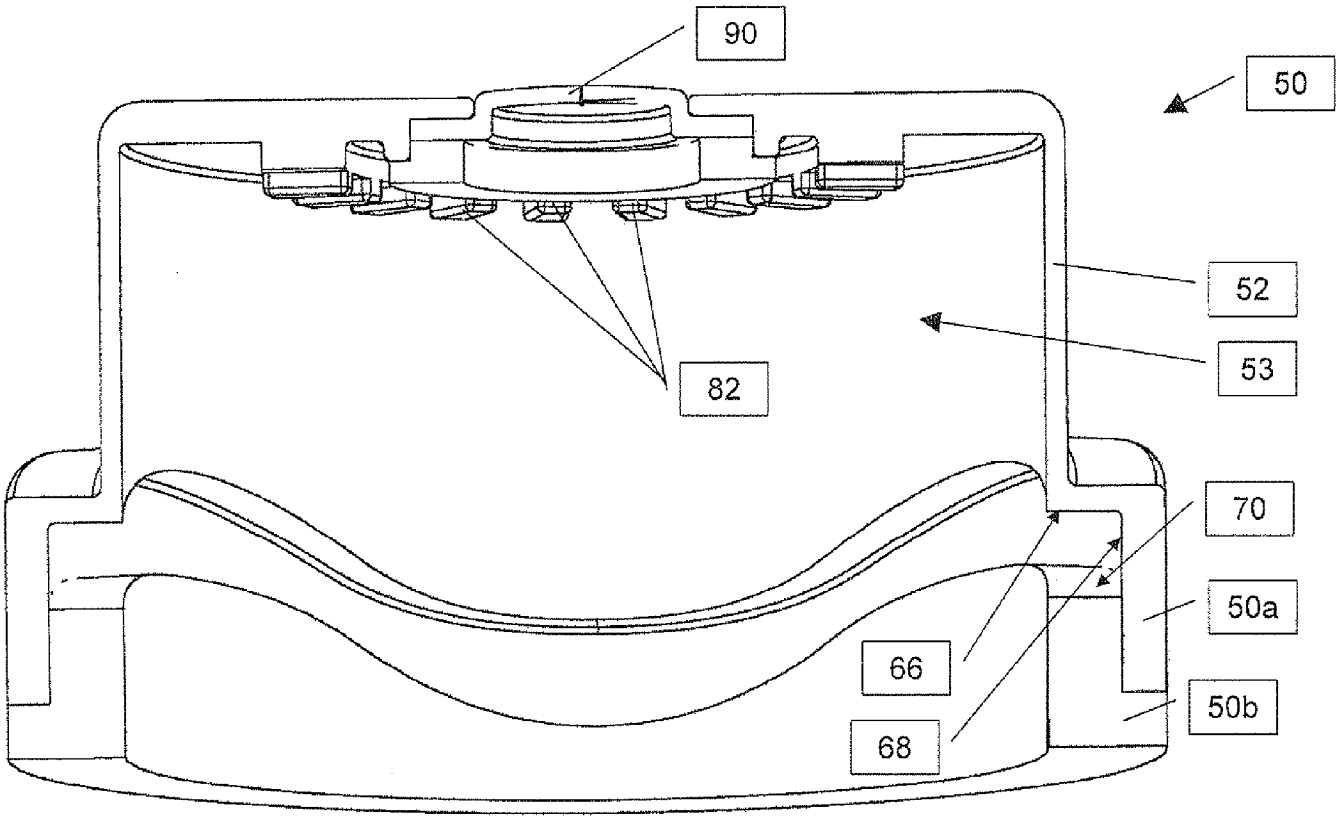
FIG. 6; is an isometric cross sectional side view of the rotatable pump cylinder of the pump lid embodiment of FIG. 2

Referring now to the drawings, FIG. 1 illustrates a pump lid 2 of the present invention deployed on a container 4, illustrated here as a bottle. The pump piston element 10 is configured with a substantially cylindrical wall 12 having an interior surface 14 and an exterior surface 16. At least a portion of the interior surface 14 is configured for the releasable attachment to the container 4 and at least a portion of the exterior surface 16 interacts with the rotatable pump cylinder 50. Therefore, the pump piston element 10 is deployed on the container 4 such that at least a portion of piston wall 12 circumscribes a portion of the container. The exterior of the pump lid 2 is the rotatable pump cylinder configuration 50 that includes a substantially cylindrical cylinder wall 52 that defines a pump cylinder region 53 (best seen in FIGS. 3, 6 and 9) in which the pump piston is deployed. Therefore, when assembled, and the pump piston 10 is deployed within the pump cylinder 50 (best seen in FIG. 3), the two components define between them a variable pump volume 100. This configuration minimizes the height above the container 4 to which the pump lid 2 of the present invention extends.

FIGS. 2-6 illustrate in greater detail a fully assembled pump lid 2 of the present invention. In this embodiment, releasable attachment of the pump piston element 10 to the container is effected by screw threads 18 configured on the interior surface 14 of the piston wall 12. The screw threads 18 are configured to engage corresponding threads on the container, such that the piston is screwed onto the container so as to circumscribe at least a portion of the container.

The exterior surface 16 of the cylindrical wall 12 includes at least one pump actuation pin element 20 extending laterally therefrom. The interior surface 54 of the cylinder wall 52 is configured with a wave-shaped groove 60 that extends over an arc of 360° around the interior surface 54.

The rotatable pump cylinder configuration 50 is deployed over the pump piston element 10 with pump actuation pin element 20 extending into wave-shaped groove 60.

Relative linear displacement between the pump piston element 10 and the rotatable pump cylinder configuration 50, so as to perform the pumping operation, is achieved by rotating the pump cylinder configuration 50 about the pump piston element 10. The interaction of the wave-shaped groove 60 with the pump actuation pin element 20 translates the rotational movement of the rotatable pump cylinder configuration 50 into linear movement of the rotatable pump cylinder configuration 50.

The embodiment illustrated in FIGS. 2-6 has three pump actuation pin elements 20 equally spaced about the exterior surface 16 of the cylindrical wall 12. Wave-shaped groove 60 on the interior surface 54 of the cylinder wall 52 is configured with a corresponding three wave forms. That is, a wave crest 62 and trough 64 for each pump actuation pin elements 20. It will be appreciated, however, that this is for illustrative purposes only and that varying the number of pump actuation pin elements 20 and the number of associated wave crests 62 and troughs 64 is within the scope of the present invention. It will be understood the number of pumping strokes (the combination of an expansion stroke and a compression stroke) per each rotation of the rotatable pump cylinder configuration 50 is equal to the number of waves forms configured in the wave shaped groove. Therefore, the embodiment of the present invention illustrated in FIGS. 2-6 will produce three linear pumping strokes per one rotation of the rotatable pump cylinder configuration 50.

Preferably, the individual components of the pump lid 2 are produced from plastics by, for non-limiting example, injection molding. For ease of manufacture, the rotatable pump cylinder configuration 50 is fabricated from two separately molded sections, a cylinder top section 50*a* and a cylinder bottom section 50*b* that when assembled define between them the wave shaped groove 60. As is clearly illustrated in FIGS. 2-4 and 6, cylinder top section 50*a* includes the top wall 66 and the side wall 68 of said wave shaped groove 60 and the cylinder bottom section 50*b* the bottom wall 70 of the wave shaped groove 60.

In operation, as the rotatable pump cylinder configuration 50 is rotated it is also linearly displaced. As the rotatable pump cylinder configuration 50 is displaced away from the pump piston element 10 the variable pump volume 100 increases and air is drawn out of the container through a one-way valve arrangement 22 configured in the pump piston element 10. As the rotatable pump cylinder configuration 50 is displaced toward the pump piston element 10 the variable pump volume 100 decreases and air is forced out of the variable pump volume 100 through one-way valve arrangement 90 configured in the top of rotatable pump cylinder configuration 50. It will be appreciated that O-ring 30 provides an air-tight seal between the rotatable pump cylinder configuration 50 and the pump piston element 10.

It will be understood that substantially any suitable one-way valve arrangement known in the art may be used. By non-limiting example, one-way valve arrangement 90 may be configured with a lip valve (also known as a sticker valve) 120 covering the opening (see FIG. 7).

Figure 8:
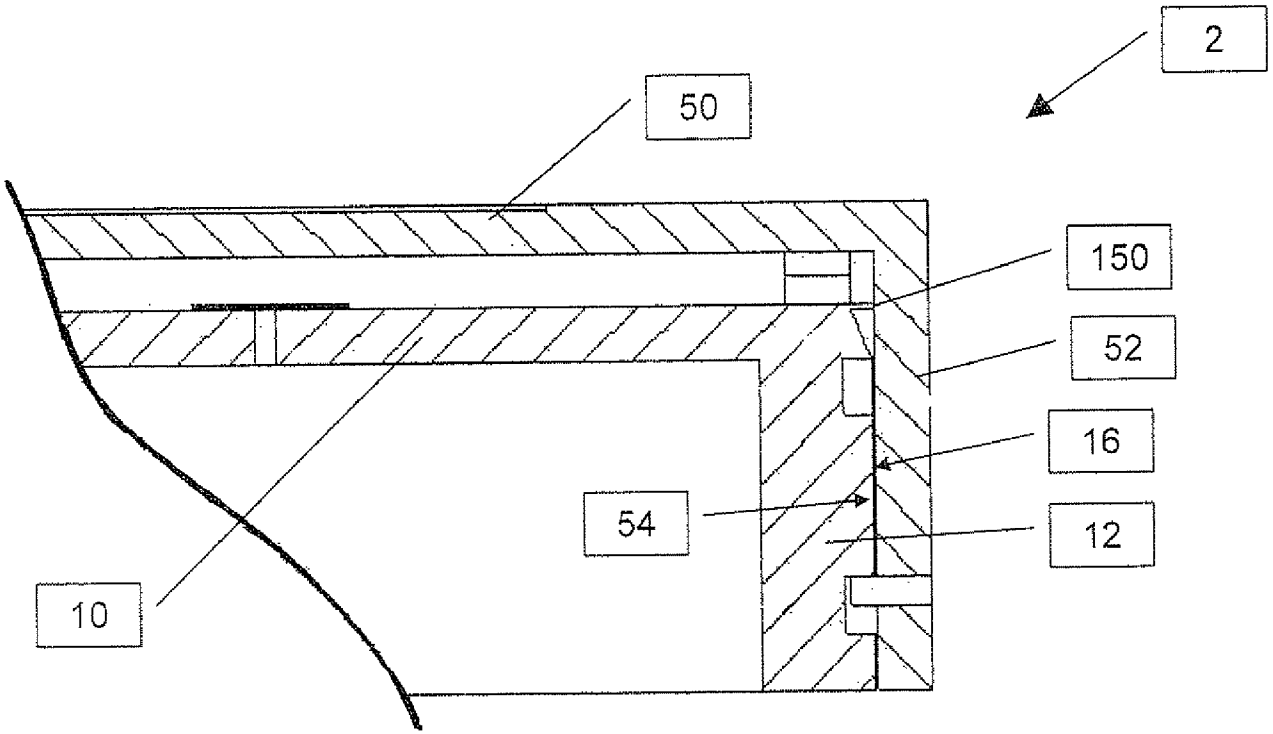
FIG. 8 is a schematic cross sectional elevation of a pump lid constructed and operational according to the teachings of the present invention, showing an alternative valve configuration at the end of a compression stroke.
Figure 9:
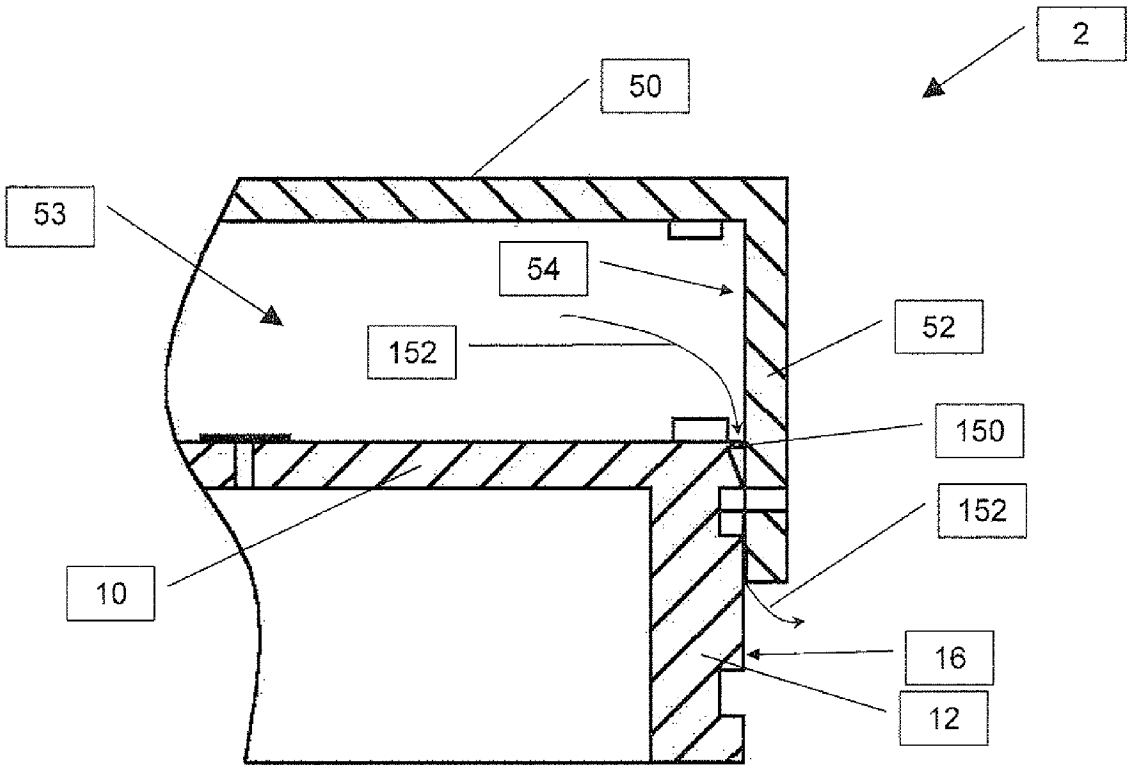
FIG. 9 is a schematic cross sectional elevation of the pump lid of FIG. 8 at the end of an expansion stroke.

Alternatively, as illustrated in FIGS. 8 and 9, both one-way valve arrangement 90 and O-ring 30 may be replaced by configuring the exterior surface 16 of the cylindrical wall 12 so as to include a resilient lip 150 that extends around the periphery of the cylindrical wall 12 and provides an air-tight seal between the rotatable pump cylinder configuration 50 and the pump piston element 10 during an expansion stroke, yet when under the pressure of a compression stroke, allows air to pass and escape between the walls of the rotatable pump cylinder configuration 50 and the pump piston element 10 as illustrated by the arrows 152.

Also illustrated are two childproof arrangements. The child-proof arrangement of FIGS. 2, 3, 5 and 6 includes circularly spaced apart teeth 42 configured in the top surface of the pump piston element 10. Corresponding teeth 82 are configured on the interior surface of the top wall of the rotatable pump cylinder configuration 50. During normal pumping operation, spring elements 44 configured in the top surface of the pump piston element 10 prevent teeth 42 and teeth 82 from meshing. In order to remove pump lid 2 from container 4 the rotatable pump cylinder configuration 50 is pressed toward the pump piston element 10 so as to mesh teeth 42 and teeth 82 at which time rotation of pump cylinder configuration 50 will also rotate the pump piston element 10, thereby unscrewing it from the container 2. It will be understood that wave-shaped groove 60 is configured such that the distance between the top wall 62 and bottom wall 66 accommodates such displacement of the pump cylinder configuration 50.

Figure 10:
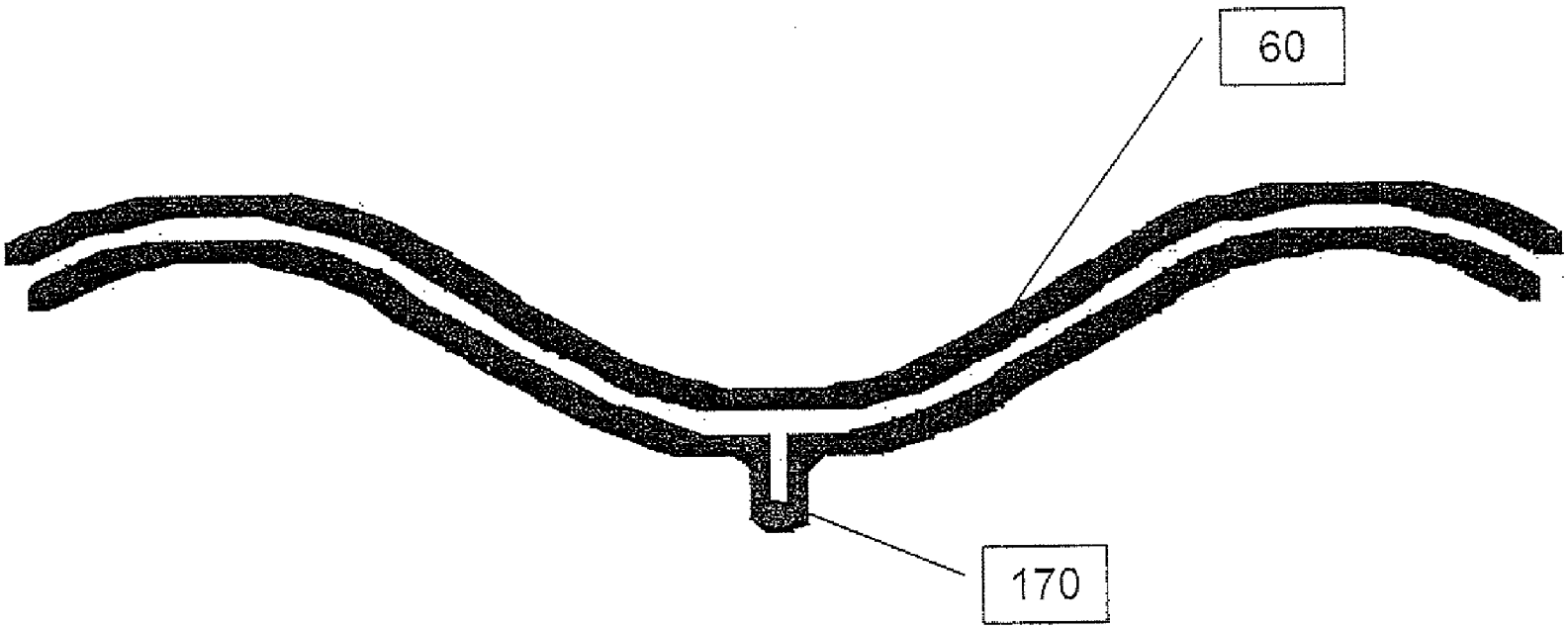
FIG. 10 is a schematic illustration of an alternative child proof arrangement constructed and operational according to the teachings of the present invention.

An alternative child-proof arrangement is illustrated in FIG. 10. As seen here, each trough of the wave-shaped groove 60 is configured with a slot 170 into which pump actuation pin elements 20 are pressed. Once the pump actuation pin elements 20 are in the slots 170 rotation of pump cylinder configuration 50 will also rotate the pump piston element 10, thereby unscrewing it from the container 2.

Figure 11A:
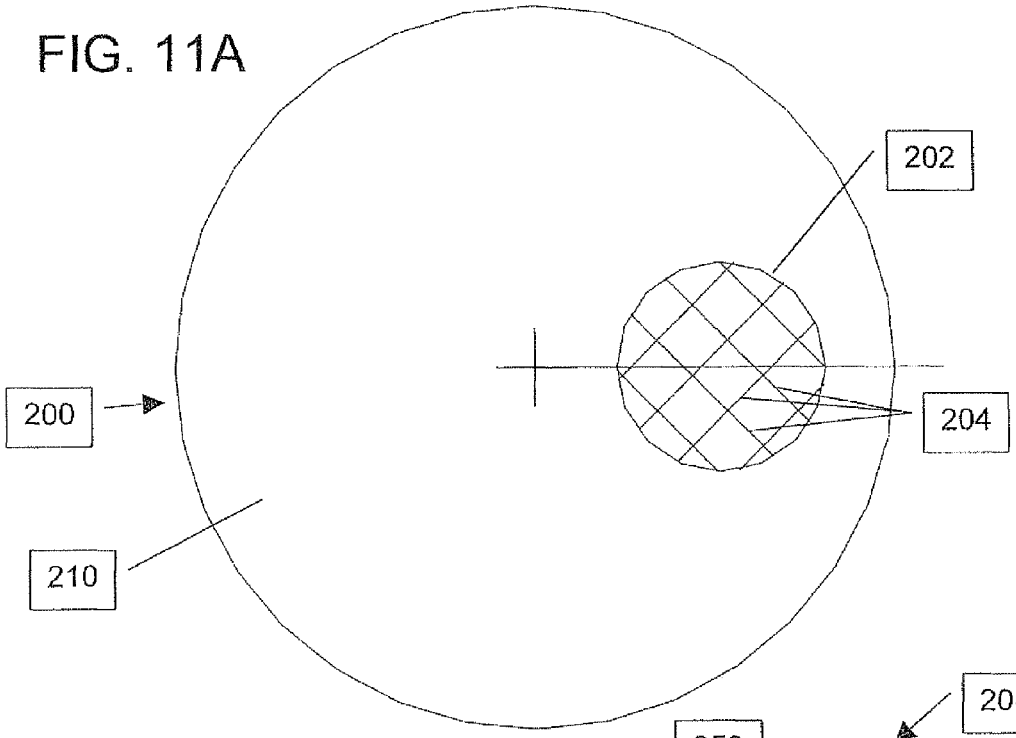
FIG. 11A is a schematic top view of the piston element of the pump lid of FIG. 11.
Figure 11:
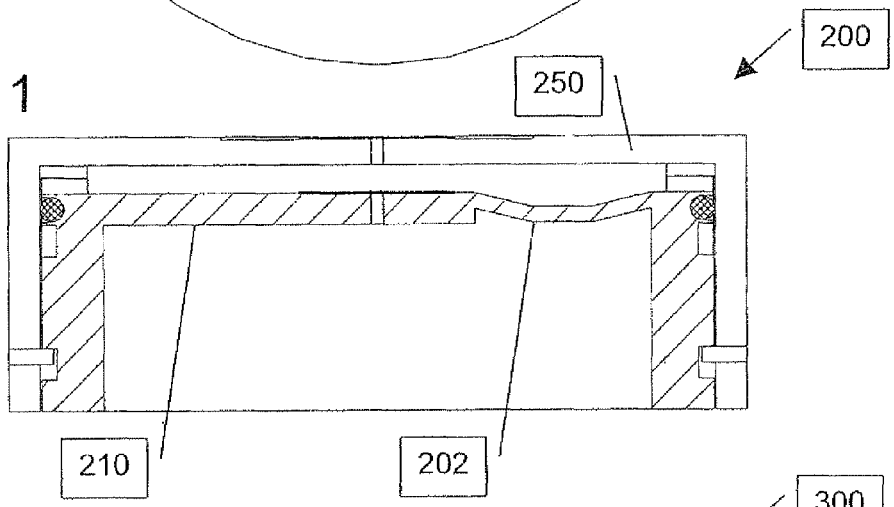
FIG. 11 is a schematic cross-sectional view of an illustrative pump lid according to the teachings of the present invention, illustrating a pressure indication configuration.

FIGS. 11 and 11A illustrate a further feature of the present invention that may be used with benefit on substantially any embodiment of a pump lid of the present invention. Illustrated here, is a flexible pressure indicator region 202 configured in the piston element 210 of pump lid 200. As shown here, it will be understood that rotatable pump cylinder configuration 250, or at least a portion thereof, is fabricated from a transparent material such that flexible pressure indicator region 202 is visible through rotatable pump cylinder configuration 250.

In operation, flexible pressure indicator region 202 is configured to flex in response to the pressure state within the container on which the pump lid is deployed. When a vacuum state exists within the container, the flexible pressure indicator region 202 is drawn inward, as illustrated here, and the pattern of the grid-lines 204 is visibly deformed. Similarly, when a pressurized state exists within the container, the flexible pressure indicator region 202 is pushed outwardly and, here again, the pattern of the grid-lines 204 is visibly deformed.

Figure 12:
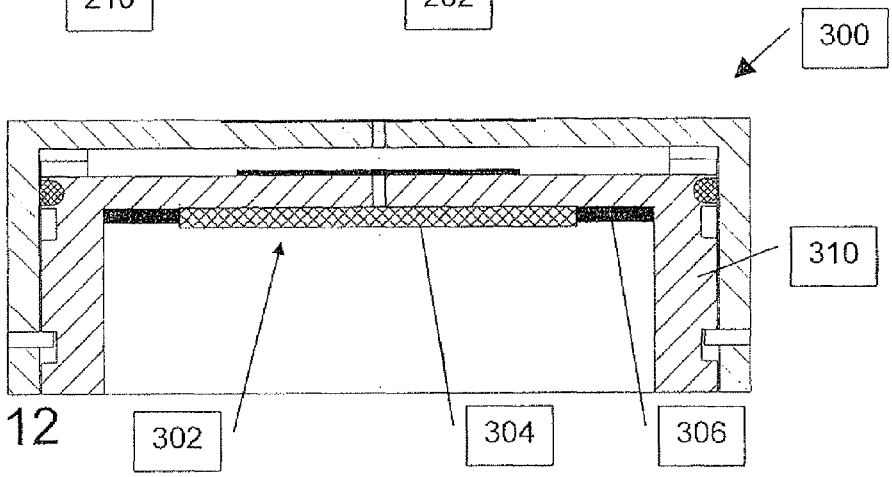
FIG. 12 is a schematic cross-sectional view of an illustrative pump lid according to the teachings of the present invention, illustrating a filter arrangement.

FIG. 12 illustrates yet another feature of the present invention that may be used with benefit on substantially any embodiment of a pump lid of the present invention. As illustrated here, pump lid 300 includes a pump piston element having a filter element 302. Filter element 302 is configured with a filter region 304 that allows the passage of air while restricting the passage of the powered contents of the container to which pump lid 300 is attached. Filter region is held in place by the attachment ring 306, which may rigid or semi-flexible and may be integrally formed with filter element 304 or may be a separate component. Attachment ring 306 may be fabricated from silicone, Teflon®, natural or synthetic rubbers, and various types of suitable plastics, as non-limiting examples.

FIGS. 13-13D illustrate a unique one-way valve arrangement (FIGS. 13A-13C) deployed in a pump lid 400 according to the present invention. Here the pump lid 400 is configured to pressurize the interior volume of the container to which it is attached.

As in other embodiments of the pump lid of the present invention, when rotatable pump cylinder configuration 450 is rotated about the pump piston element 410 rotatable pump cylinder configuration 450 is longitudinally displaced outwardly, as seen in FIG. 13D, and air is drawn through inlet opening 462 past one-way valve 464 and into the interior volume 460 of rotatable pump cylinder configuration 450.

Upon further rotation of rotatable pump cylinder configuration 450 about the pump piston element 410 rotatable pump cylinder configuration 450 is longitudinally displaced inwardly, as seen in FIG. 13A, and air is pushed through outlet opening 406 past one-way valve arrangement 402/404 and into the interior volume of the container (not shown).

As seen in FIGS. 13A-13C, one-way valve arrangement 402/404 includes two valve components. Valve component 402 is configured with a through slit 402*a* disposed along a substantially vertical center line of valve component 402. Similarly, valve component 404 is configured with a through slit 404*a* disposed along a substantially horizontal center line of valve component 404. It will be understood that the linear motion of the pump lid 400 forces air through slits 404*a* and 404*b*.

As illustrated in FIG. 13C, when the two valve components 402 and 404 are deployed within pump piston element 410 the two slits 402*a* and 404*a* are aligned at right angles (90°) one to another. It will be appreciated that although the preferred embodiment of the one-way valve arrangement 402/404 illustrated herein is configured as circular valve components having slits that intersect at a center point of the two overlapping circles, these are not necessities of the one-way valve arrangement 402/404 of the present invention, nor is the order of deployment. It will be readily understood that the exterior shape of the valve components may be of substantially any suitable shape nor need each of the valve components be of the same shape. Further, the slits need not be configured so as to intersect at right angles at the center point of the two overlapping valve components. Therefore, embodiments having slits aligned at other than right angles and/or intersecting at a point other than a center point are within the scope of the present invention. It should be noted that experimentation has show the use of only one valve component, either 402 or 404, to be effective for maintaining a useful pressure differential within the interior volume for some applications.

It will be appreciated that one-way valve arrangement 402/404 may be constructed as an integrally formed single unit. Alternatively, as illustrated here, as two separate valve components, 402 and 404, which may be held in place by a retainer element, for a total of three pieces.

Further, valve components 402 and 404 may be fabricated from substantially any suitable material such as, but not limited to, natural rubber, synthetic rubber, silicon, soft resilient plastics and the like.

It will be appreciated that valve components 402 and 404 may be fabricated from substantially any suitable flexible material such as, but not limited to, silicone, Teflon®, natural or synthetic rubbers, and various types of suitable plastics.

Figure 14:
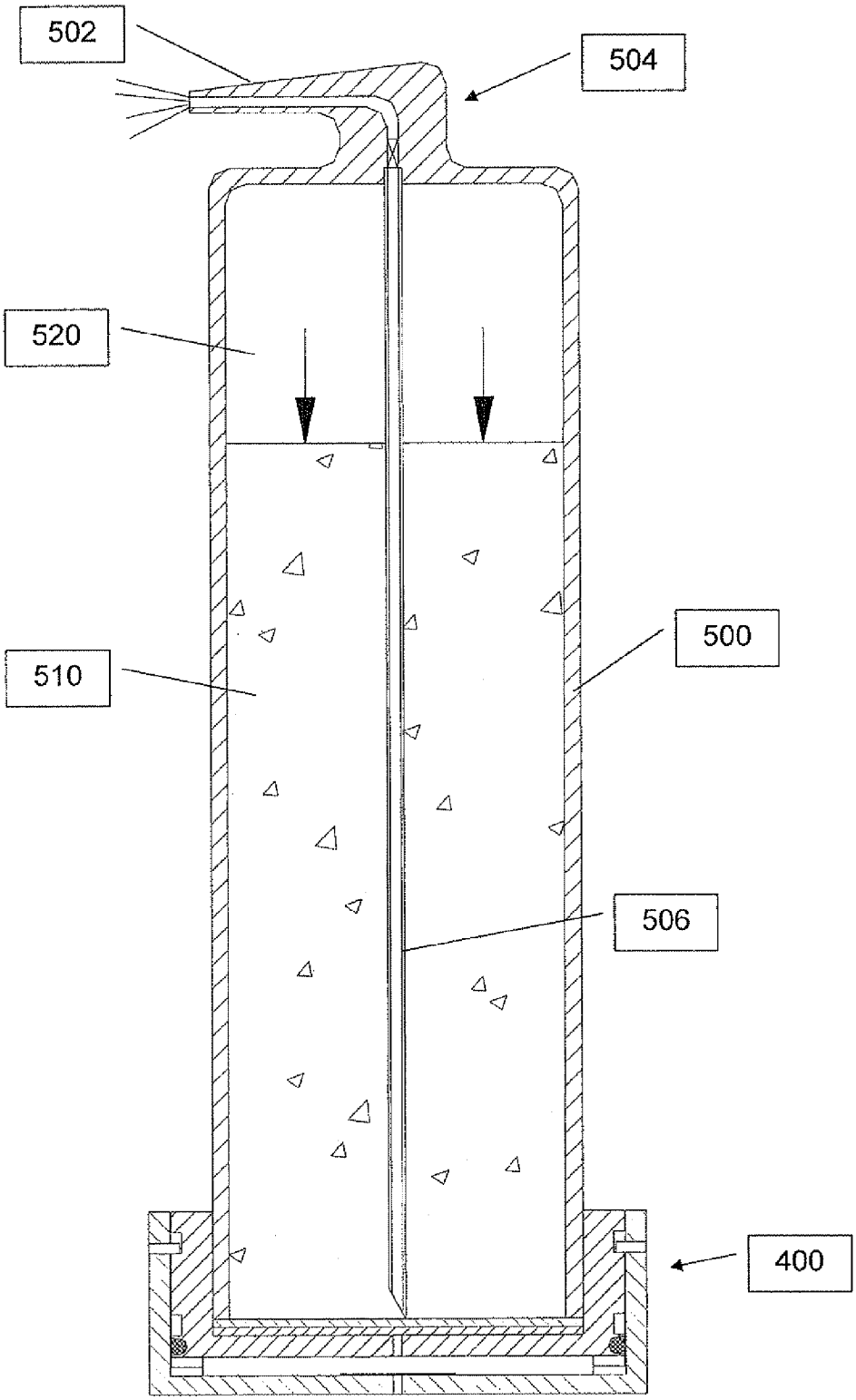
FIG. 14 is a schematic cross-sectional view of an illustrative pump lid according to the teachings of the present invention, illustrating deployment of the lid on a spray bottle in which the pressurized air is free to make contact with the liquid contents of the spray bottle.
Figure 15:
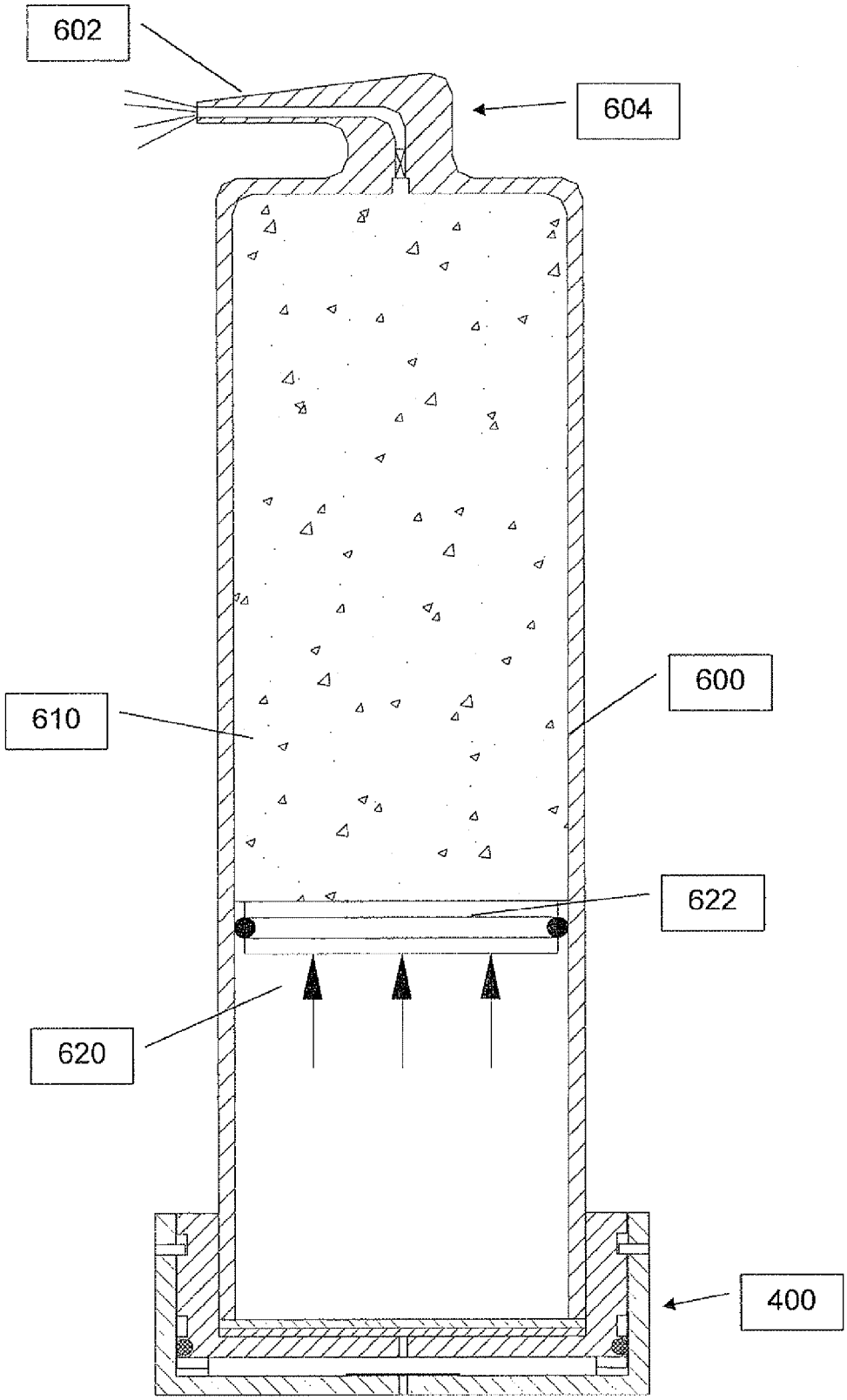
FIG. 15 is a schematic cross-sectional view of an illustrative pump lid according to the teachings of the present invention, illustrating deployment of the lid on a spray bottle in which the pressurized air is separated form the liquid contents of the spray bottle.

FIGS. 14 and 15 illustrate the deployment of pump lid 400 on containers containing fluids for pressurized discharge from the container.

The container 500 of FIG. 14 is configured for fluids that are not sensitive to direct contact with air, therefore, air is pumped using pump lid 400 directly into the interior volume of container 500. Container 500 is configured with a release control arrangement 504 as is known in the art for the release of fluid through outlet nozzle 502.

In operation, as pump lid 400 is actuated, air pressure builds up in region 520 within the interior volume of container 500 and consequently pressurizes fluid 510. When the release control arrangement 504 is activated, fluid 510 enters outlet tube 506 and is released through outlet nozzle 502. Such release of fluid 510 may be as, but not limited to, a spray, continuous flow, mist or foam.

The container 600 of FIG. 15 is configured for fluids that are sensitive to direct contact with air, therefore, air is pumped using pump lid 400 directly into region 620 in the interior volume of container 600. Region 620 is separated from direct contact with fluid 610 by barrier 622 that is displaceable within container 600 by the application of air pressure within region 620. It will be understood that barrier 622 may be configured as substantially any suitable separating element and may be of substantially and suitable shape. The illustrations provided here are by example only and are not intended to limit the scope of the present invention. Container 600 is also configured with a release control arrangement 604 as is known in the art for the release of fluid through outlet nozzle 602.

In operation, as pump lid 400 is actuated, air pressure builds up in region 620 within the interior volume of container 600 and consequently applies pressure to barrier 622 so as to pressurize fluid 610. When the release control arrangement 604 is activated, fluid 610 is released through outlet nozzle 602. Such release of fluid 610 may be as, but not limited to, a spray, continuous flow, mist or foam.

It should be noted that release of the pressurized fluid in both containers 500 and 600 need not be immediately after pressurization and that the fluid may remain in the container in a pressurized state for an extended period of time.

It will be appreciated that the above descriptions are intended only to serve as examples and that many other embodiments are possible within the spirit and the scope of the present invention.

What is claimed is:

1. A container for the pressurized discharge of a fluid contained therein, the container comprising:

a) a container body;

b) a pump lid deployed on said container body for pressurizing an interior volume of the container, said pump lid having:

i) a rotatable pump cylinder configuration; and ii) a pump piston mechanically associated with said rotatable pump cylinder configuration such that at least a portion of said piston is deployed within said pump cylinder, thereby defining between them a variable pump volume, said pump piston configured with a substantially cylindrical piston wall having an interior surface and an exterior surface such that at least a portion of said interior surface is configured for releasable attachment to the container and at least a portion of said exterior surface interacts with said rotatable pump cylinder configuration;

wherein said association is such that rotation of said rotatable pump cylinder configuration generates linear motion of said rotatable pump cylinder configuration;

c) a release control arrangement; and d) an outlet nozzle.

2. The container of claim 1, further including a barrier deployed within the interior volume of the container so as to separate pressurized air from the fluid contained in the container.

3. A method for discharging pressurized fluid from a container, the method comprising:

a) providing a container body;

b) providing a pump lid deployed on said container body for pressurizing an interior volume of the container, said pump lid having:

i) a rotatable pump cylinder configuration; and ii) a pump piston mechanically associated with said rotatable pump cylinder configuration such that at least a portion of said piston is deployed within said pump cylinder, thereby defining between them a variable pump volume, said pump piston configured with a substantially cylindrical piston wall having an interior surface and an exterior surface such that at least a portion of said interior surface is configured for releasable attachment to the container and at least a portion of said exterior surface interacts with said rotatable pump cylinder configuration;

wherein said association is such that rotation of said rotatable pump cylinder configuration generates linear motion of said rotatable pump cylinder configuration;

c) actuating said pump lid so as to pressurize an interior volume of the container; and d) activating a release control arrangement so as to discharge the fluid through an outlet nozzle.

4. A pump lid assembly for use with a container, the lid assembly comprising:

a) a rotatable pump cylinder configuration;

b) a pump piston mechanically associated with said rotatable pump cylinder configuration such that at least a portion of said piston is deployed within said pump cylinder, thereby defining between them a variable pump volume, said pump piston configured with a substantially cylindrical piston wall having an interior surface and an exterior surface such that at least a portion of said interior surface is configured for releasable attachment to the container and at least a portion of said exterior surface interacts with said rotatable pump cylinder configuration;

wherein said association is such that rotation of said rotatable pump cylinder configuration generates linear motion of said rotatable pump cylinder configuration; and c) a one-way valve arrangement comprising at least one valve component having a through slit through which air is forced by said linear motion.

5. The pump lid of claim 4, wherein said exterior surface of said cylindrical piston wall includes at least one pin element extending laterally therefrom.

6. The pump lid of claim 5, wherein said rotatable pump cylinder configuration includes a substantially cylindrical cylinder wall that defines a pump cylinder region in which said pump piston is deployed, said substantially cylindrical cylinder wall configured with a wave shaped groove into which said pin element extends.

7. The pump lid of claim 6, wherein said rotatable pump cylinder configuration includes at least two components that when assembled define between them said wave shaped groove.

8. The pump lid of claim 7, wherein said two components, when assembled, define between them said wave shaped groove and are configured such that a first component includes a top wall and a side wall of said wave shaped groove and a second component includes a bottom wall of said wave shaped groove.

9. The pump lid of claim 4, wherein said exterior surface of said cylindrical piston wall includes a resilient lip that extends around a periphery of said cylindrical wall and provides an air-tight seal between said rotatable pump cylinder configuration and said pump piston element during an expansion stroke, and when under pressure of a compression stroke, allows air to pass between said rotatable pump cylinder configuration and said pump piston element.

10. The pump lid of claim 4, wherein said at least one valve component is configured as at least two valve components, each of said at least two valve components having a slit wherein upon deployment, said slits are aligned so as to intersect one another at an angle.

11. The one-way valve of claim 10, wherein said slits are aligned so as to intersect one another at right angles.

* * * * *